US009096956B2

(12) United States Patent
Shiflett et al.

(10) Patent No.: US 9,096,956 B2
(45) Date of Patent: Aug. 4, 2015

(54) PROCESS FOR THE PRODUCTION OF CARBON FIBERS FROM POLY(α(1-→3) GLUCAN) FIBERS

(71) Applicant: E I DU PONT DE NEMOURS AND COMPANY, Wilmington, DE (US)

(72) Inventors: Mark Brandon Shiflett, Wilmington, DE (US); Beth Ann Elliott, Claymont, DE (US)

(73) Assignee: E I DU PONT DE NEMOURS AND COMPANY, Wilmington, DE (US)

( * ) Notice: Subject to any disclaimer, the term of this patent is extended or adjusted under 35 U.S.C. 154(b) by 389 days.

(21) Appl. No.: 13/770,068

(22) Filed: Feb. 19, 2013

(65) Prior Publication Data

US 2013/0214443 A1 Aug. 22, 2013

Related U.S. Application Data

(60) Provisional application No. 61/600,338, filed on Feb. 17, 2012.

(51) Int. Cl.
*D01F 9/16* (2006.01)
*D01F 9/24* (2006.01)

(52) U.S. Cl.
CPC ... *D01F 9/24* (2013.01); *D01F 9/16* (2013.01)

(58) Field of Classification Search
CPC ..... D01F 9/12; D01F 9/14; D01F 9/16; D01F 9/20; D01F 9/24; Y10S 264/19
USPC ..... 264/29.2, 29.6, 29.7, DIG. 19
See application file for complete search history.

(56) References Cited

U.S. PATENT DOCUMENTS

| | | | | |
|---|---|---|---|---|
| 3,552,923 | A * | 1/1971 | Carpenter et al. | 423/447.6 |
| 3,723,609 | A * | 3/1973 | Mansmann et al. | 423/447.1 |
| 4,501,886 | A | 2/1985 | O'Brien | |
| 7,000,000 | B1 | 2/2006 | O'Brien | |

OTHER PUBLICATIONS

Simpson, Christine L. et al., Four glucosyltransferases, GtfJ, GtfK, GtfL and GtfM, from *Streptococcus salivarius* ATCC 25975, Microbiology, 1995, pp. 1451-1460, vol. 141, Month of Publication Unknown.

* cited by examiner

*Primary Examiner* — Michael Tolin

(57) ABSTRACT

A process is provided for preparation of carbon fibers based from fibers of poly(α(1→3) glucan). The method comprises three thermal exposures at progressively higher temperatures to drive off volatiles, thermally stabilize the glucan fiber, and carbonize the thermally stabilized fiber. The carbon fibers prepared according to the process hereof are strong, stiff, tough, and easily handled.

5 Claims, 4 Drawing Sheets

Front View

Top View

PROCESS FOR THE PRODUCTION OF CARBON FIBERS FROM POLY(α(1-→3) GLUCAN) FIBERS

FIELD OF THE INVENTION

The invention relates to carbon fibers, processes of preparing the carbon fibers and the use of the carbon fibers in various applications.

BACKGROUND OF THE INVENTION

Carbon fibers are generally defined as a fiber containing at least about 92 wt-% of carbon. Carbon fibers containing 99 wt-% or more of carbon are often referred to as graphite fibers. Carbon fibers (CFs) are used in various applications owing to their excellent tensile properties, thermal and chemical stabilities (in absence of oxidizing agents) and thermal and electrical conductivities. The conventional applications of CFs include aircraft frames, turbine blades, automobile panels, sporting goods and industrial components.

Currently, the carbon fiber market is dominated by carbon fiber derived from polyacrylonitrile (PAN), with the balance being made up of fibers from pitch and rayon. CFs with distinct properties result from the processing of different precursor fibers. In a typical process in the art for converting organic polymer fibers into carbon fibers, the organic polymer fiber is first heat-stabilized in air in an oxidation process conducted at a temperature of 200 to 400° C. The thus stabilized precursor fibers then undergo controlled pyrolysis, i.e., a carbonization step, comprising heat-treating in an inert atmosphere such as nitrogen to a temperature of from about 300° C. to about 3000° C., which removes non-carbon elements such as hydrogen, oxygen and nitrogen from the oxidized fiber. It is known in the art that heating at the higher end of the temperature spectrum, e.g., between about 1000° C. and about 3000° C. may achieve higher carbon content, thereby producing CFs with higher Young's modulus values.

For automotive applications, desired mechanical properties for carbon fibers include tensile strength of >1.72 GPa, tensile modulus of >172 GPa and elongation at break of about 1%.

In addition to the limited mechanical properties of conventional CFs, the currently used methods of preparing CFs can be costly. For example, the cost of the precursor fiber amounts to approximately 40% to 50% of the total cost of preparing the carbon fiber. Therefore, there is a need in the art for lower cost precursor fibers that yield carbon fibers of excellent quality would significantly reduce the cost of CFs. An additional benefit would be to enable the expansion of CF applications to industries and markets such as those related to the automotive industry.

Furthermore, it is desirable to provide a source of carbon fibers that derives from a renewable source that does not contribute to global warming.

Polysaccharides have been known since the dawn of civilization, primarily in the form of cellulose, a polymer formed from glucose by natural processes via β(1→4) glycoside linkages; see, for example, *Applied Fibre Science*, F. Happey, Ed., Chapter 8, E. Atkins, Academic Press, New York, 1979. Numerous other polysaccharide polymers are also disclosed therein.

Only cellulose among the many known polysaccharides has achieved commercial prominence as a fiber. In particular, cotton, a highly pure form of naturally occurring cellulose, is well-known for its beneficial attributes in textile applications.

It is further known that cellulose exhibits sufficient chain extension and backbone rigidity in solution to form liquid crystalline solutions; see, for example O'Brien, U.S. Pat. No. 4,501,886. The teachings of the art suggest that sufficient polysaccharide chain extension could be achieved only in β(1→4) linked polysaccharides and that any significant deviation from that backbone geometry would lower the molecular aspect ratio below that required for the formation of an ordered phase.

More recently, glucan polymer, characterized by α(1→3) glycoside linkages, has been isolated by contacting an aqueous solution of sucrose with GtfJ glucosyltransferase isolated from *Streptococcus salivarius*, Simpson et al., Microbiology, vol 141, pp. 1451-1460 (1995). Highly crystalline, highly oriented, low molecular weight films of α(1→3)-D-glucan have been fabricated for the purposes of x-ray diffraction analysis, Ogawa et al., Fiber Diffraction Methods, 47, pp. 353-362 (1980). In Ogawa, the insoluble glucan polymer is acetylated, the acetylated glucan dissolved to form a 5% solution in chloroform and the solution cast into a film. The film is then subjected to stretching in glycerine at 150° C. which orients the film and stretches it to a length 6.5 times the original length of the solution cast film. After stretching, the film is deacetylated and crystallized by annealing in superheated water at 140° C. in a pressure vessel. It is well-known in the art that exposure of polysaccharides to such a hot aqueous environment results in chain cleavage and loss of molecular weight, with concomitant degradation of mechanical properties.

Polysaccharides based on glucose and glucose itself are particularly important because of their prominent role in photosynthesis and metabolic processes. Cellulose and starch, both based on molecular chains of polyanhydroglucose are the most abundant polymers on earth and are of great commercial importance. Such polymers offer materials that are environmentally benign throughout their entire life cycle and are constructed from renewable energy and raw materials sources.

The term "glucan" is a term of art that refers to a polysaccharide comprising beta-D-glucose monomer units that are linked in eight possible ways, Cellulose is a glucan.

Within a glucan polymer, the repeating monomeric units can be linked in a variety of configurations following an enchainment pattern. The nature of the enchainment pattern depends, in part, on how the ring closes when an aldohexose ring closes to form a hemiacetal. The open chain form of glucose (an aldohexose) has four asymmetric centers (see below). Hence there are $2^4$ or 16 possible open chain forms of which D and L glucose are two. When the ring is closed, a new asymmetric center is created at C1 thus making 5 asymmetric carbons. Depending on how the ring closes, for glucose, α(1→4)-linked polymer, e.g. starch, or β(1→4)-linked polymer, e.g. cellulose, can be formed upon further condensation to polymer. The configuration at C1 in the polymer determines whether it is an alpha or beta linked polymer, and the numbers in parenthesis following alpha or beta refer to the carbon atoms through which enchainment takes place.

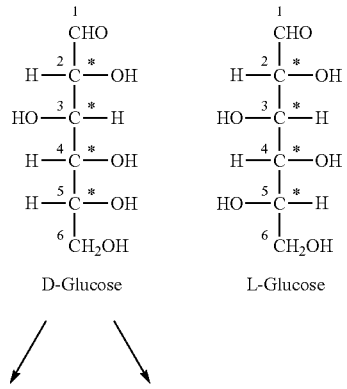

-continued

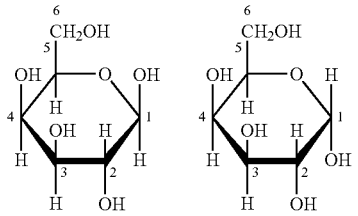

α-D Glucose β-D Glucose

* asymmetric carbon center

The properties exhibited by a glucan polymer are determined by the enchainment pattern. For example, the very different properties of cellulose and starch are determined by the respective nature of their enchainment patterns. Starch or amylose consists of α(1→4) linked glucose and does not form fibers among other things because it is swollen or dissolved by water. On the other hand, cellulose consists of β(1→4) linked glucose, and makes an excellent structural material being both crystalline and hydrophobic, and is commonly used for textile applications as cotton fiber, as well as for structures in the form of wood.

Like other natural fibers, cotton has evolved under constraints wherein the polysaccharide structure and physical properties have not been optimized for textile uses. In particular, cotton fiber is of short fiber length, limited variation in cross section and fiber fineness and is produced in a highly labor and land intensive process.

O'Brien, U.S. Pat. No. 7,000,000 discloses a process for preparing fiber from liquid crystalline solutions of acetylated poly(α(1→3) glucan). The thus prepared fiber was then deacetylated resulting in a fiber of poly(α(1→3) glucan).

The inventive method described herein, results in carbon fibers meeting these desired mechanical benchmarks and would further reduce the costs making CFs available to additional industrial sectors.

SUMMARY OF THE INVENTION

A process comprising subjecting one or more filaments of poly(α(1→3) glucan) to a tension below the breaking strength of the one or more filaments at 350° C.;

subjecting the thus tensioned one or more filaments to a first thermal exposure by heating said one or more filaments to a temperature in the range of 160 to 200° C. in air for a duration in the range of 5 to 15 minutes;

subjecting the thus heated one or more filaments to a second thermal exposure by further heating said one or more filaments at a heating rate, still under tension, from a first temperature in the range of 200 to 250° C. to a second temperature in the range of 300 to 350° C., said heating rate being in the range of 0.1 to 1° C. per minute, thereby preparing one or more thermally stabilized filaments;

subjecting said one or more stabilized filaments in a zero tension state to a third thermal exposure by heating said one or stabilized filaments to a temperature in the range of 700 to 1500° C. in an inert atmosphere for a duration in the range of 0.5 to 5 minutes, thereby preparing one or more carbonized filaments.

DETAILED DESCRIPTION OF THE INVENTION

Figure 1:
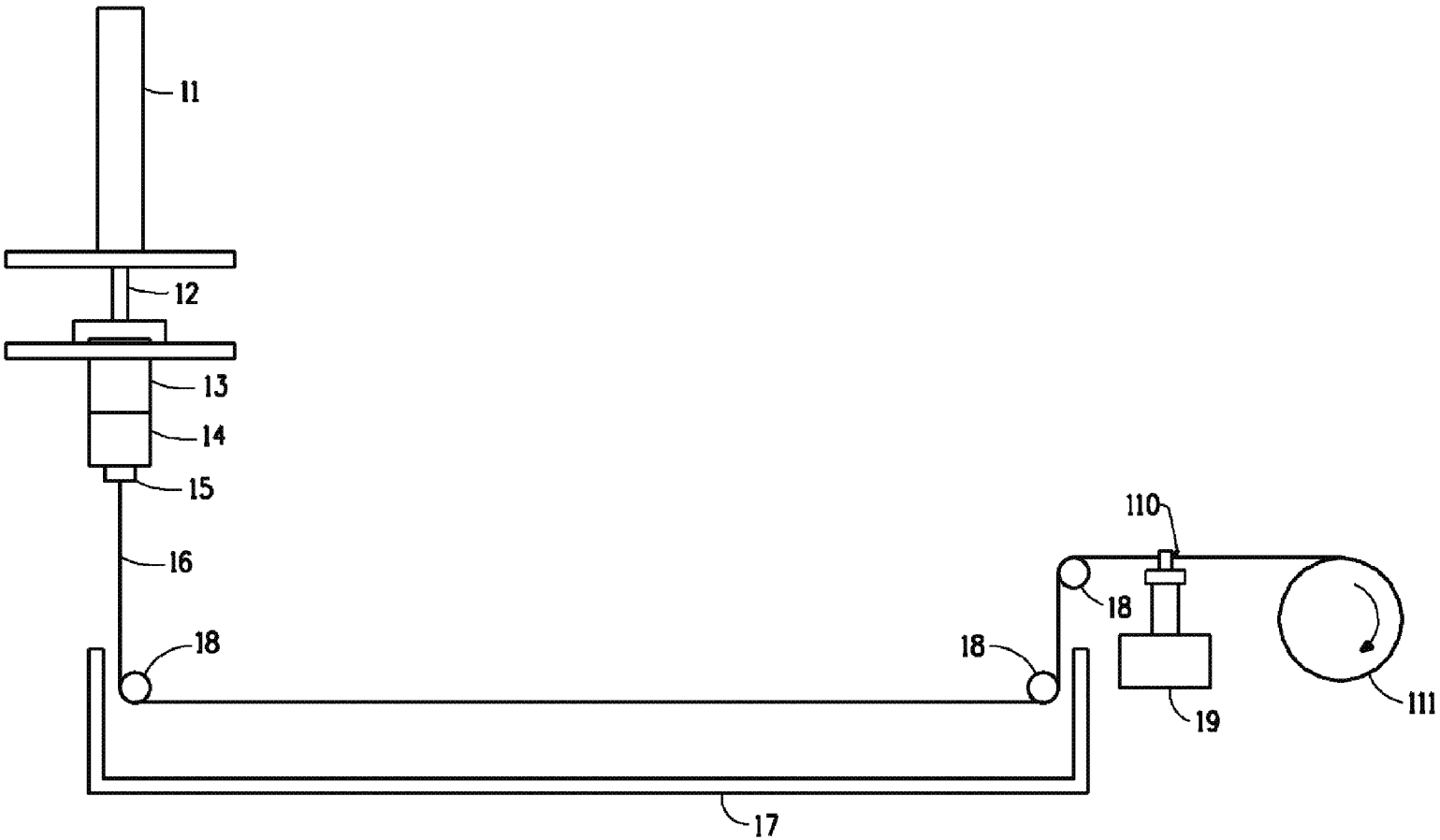
FIG. 1 depicts a side view of the fiber spinning apparatus employed in the specific embodiments hereof.

When a range of values is provided herein, it is intended to encompass the end-points of the range unless specifically stated otherwise. Numerical values used herein have the precision of the number of significant figures provided, following the standard protocol in chemistry for significant figures as outlined in ASTM E29-08 Section 6. For example, the number 40 encompasses a range from 35.0 to 44.9, whereas the number 40.0 encompasses a range from 39.50 to 40.49.

As used herein, the term "filament" encompasses a thread-shaped compact unit comprising one or more molecules of a polymer comprising poly(α(1→3) glucan). The filament can further comprise additional polymers added, for example, order to control the morphology of the carbon fiber produced according to the process hereof. Such additives as are commonly employed in the art of carbon fiber production to enhance the properties or processing of organic polymers undergoing solution spinning and subsequent carbonization can also be included.

In the present invention, the term "fiber" and the term "filament" are used interchangeably. The present invention is directed to the preparation of high strength, high modulus carbon fibers from a fiber precursor comprising poly(α(1→3) glucan). Suitable poly(α(1→3) glucan) fibers are in the form of continuous filaments. Staple fibers are not well suited for the practice of the present invention.

According to the present invention a process is provided for the preparation of carbon fiber from a precursor fiber comprising poly(α(1→3) glucan), the process comprising subjecting one or more filaments comprising poly(α(1→3) glucan) to a tension below the breaking strength of the one or more filaments at 350° C.;

subjecting the thus tensioned one or more filaments to a first thermal exposure by heating said one or more filaments to a temperature in the range of 160 to 200° C. in air for a duration in the range of 5 to 15 minutes;

subjecting the thus heated one or more filaments to a second thermal exposure by further heating said one or more filaments at a heating rate, still under tension, from a first temperature in the range of 200 to 250° C. to a second temperature in the range of 300 to 350° C., said heating rate being in the range of 0.1 to 1° C. per minute, thereby preparing one or more thermally stabilized filaments;

subjecting said one or more stabilized filaments in a zero tension state to a third thermal exposure by heating said one or stabilized filaments to a temperature in the range of 700 to 1500° C. in an inert atmosphere for a duration in the range of 0.5 to 5 minutes, thereby preparing one or more carbonized filaments.

One benefit of the present invention over the known art is that the carbon fiber resulting from the process hereof is a "green" product—that is, it is biologically sourced because the poly(α(1→3) glucan) upon which it is based is produced by fermentation, and not from petroleum.

If the first thermal exposure is conducted at a temperature below 160° C., it may be ineffective. If the first thermal exposure is conducted at a temperature above 200° C., it can cause water molecules trapped within fiber pores to evaporate too quickly and rupture the fiber, causing points of weakness where the fiber can break. The duration of exposure less than 5 minutes is not highly effective. An exposure of greater than 15 minutes is not deleterious, but is unnecessary. In one embodiment of the process hereof, the first thermal exposure is effected at a temperature in the range of 175 to 185° C. for a duration of 7.5 to 12.5 minutes.

Thermal stabilization of the poly($\alpha$(1→3) glucan) fiber is effected in a second thermal exposure, which involves heating from a first temperature in the range 200 to 250° C., preferably 230 to 250° C., to a second temperature in the range of 300 to 350° C., preferably 310 to 330° C. At a temperature below 200° C., thermal stabilization does not occur or occurs at a rate that is impractically slow. At a temperature above 350° C., the fiber can melt and break.

In one embodiment of the process hereof, said second thermal exposure is effected in a series of well-defined steps between the first temperature and the second temperature, with a hold period between steps, and a heating rate from step to step in excess of 10° C. per minute.

The first and second thermal exposures are conducted in air or an oxygen containing atmosphere. If the first and second thermal exposures are conducted in an oxygen containing atmosphere other than air, the same sequence of steps will still be operative, but will be modified in detail to accommodate the atmosphere in question.

The third thermal exposure, the carbonization step, is effected in an inert environment. Any inert environment is satisfactory. A heavy nitrogen purge, as described in the specific embodiments infra, has been found to be satisfactory. The third thermal exposure is conducted in the temperature range of 700 to 1500° C., preferably 800 to 1000° C. At a temperature below 700° C., the necessary level of pyrolysis and carbonization does not occur. At temperatures above 1500° C., the resulting carbon fiber can undergo such deleterious changes as loss of integrity, melting and others.

When the third thermal exposure is conducted for a period of time less than 0.5 minutes, insufficient carbonization takes place. For a period of time more than 5 minutes, the resulting carbon fiber may undergo deleterious changes, particularly in the higher range of carbonization temperatures. In one embodiment, the third thermal exposure is effected in the temperature range of 800 to 1000° C. for a period of time of 1 to 2 minutes.

The resulting carbon fiber is strong, very stiff, and tough.

The invention is further described in, but not limited by, the following specific embodiments.

Examples

Materials

| MATERIAL | Description | Vendor |
|---|---|---|
| Dialysis tubing | Spectrapor 25225-226, 12000 molecular weight cut-off | VWR (Radnor, PA). |
| Sucrose | 15 wt-% solids aqueous solution (#BDH8029) | VWR. |
| Dextran | T-10 (#D9260) | Sigma Aldrich. |
| Ethanol | Undenatured (#459844) | Sigma Aldrich |
| Antifoam | Suppressor 7153 | Cognis Corporation (Cincinnati, OH). |

All other chemicals were obtained from commonly used suppliers of such chemicals.

Preparation of Glucosyltransferase (gtfJ) Enzyme

Seed Medium

The seed medium, used to grow the starter cultures for the fermenters, contained: yeast extract (Amberex 695, 5.0 grams per liter, g/L), $K_2HPO_4$ (10.0 g/L), $KH_2PO_4$ (7.0 g/L), sodium citrate dihydrate (1.0 g/L), $(NH_4)_2SO_4$ (4.0 g/L), $MgSO_4$ heptahydrate (1.0 g/L) and ferric ammonium citrate (0.10 g/L). The pH of the medium was adjusted to 6.8 using either 5N NaOH or $H_2SO_4$ and the medium was sterilized in the flask. Post sterilization additions included glucose (20 mL/L of a 50% w/w solution) and ampicillin (4 mL/L of a 25 mg/mL stock solution).

Fermenter Medium

The growth medium used in the fermenter contained: $KH_2PO_4$ (3.50 g/L), $FeSO_4$ heptahydrate (0.05 g/L), $MgSO_4$ heptahydrate (2.0 g/L), sodium citrate dihydrate (1.90 g/L), yeast extract (Amberex 695, 5.0 g/L), Suppressor 7153 antifoam (0.25 milliliters per liter, mL/L), NaCl (1.0 g/L), $CaCl_2$ dihydrate (10 g/L), and NIT trace elements solution (10 mL/L). The NIT trace elements solution contained citric acid monohydrate (10 g/L), $MnSO_4$ hydrate (2 g/L), NaCl (2 g/L), $FeSO_4$ heptahydrate (0.5 g/L), $ZnSO_4$ heptahydrate (0.2 g/L), $CuSO_4$ pentahydrate (0.02 g/L) and $NaMoO_4$ dihydrate (0.02 g/L). Post sterilization additions included glucose (12.5 g/L of a 50% w/w solution) and ampicillin (4 mL/L of a 25 mg/mL stock solution).

Construction of Glucosyltransferase (gtfJ) Enzyme Expression Strain

A gene encoding the mature glucosyltransferase enzyme (gtfJ; EC 2.4.1.5; GENBANK® AAA26896.1, SEQ ID NO: 3) from *Streptococcus salivarius* (ATCC 25975) was synthesized using codons optimized for expression in *E. coli* (DNA 2.0, Menlo Park Calif.). The nucleic acid product (SEQ ID NO: 1) was subcloned into pJexpress404® (DNA 2.0, Menlo Park Calif.) to generate the plasmid identified as pMP52 (SEQ ID NO: 2). The plasmid pMP52 was used to transform *E. coli* MG1655 (ATCC47076™) to generate the strain identified as MG1655/pMP52. All procedures used for construction of the glucosyltransferase enzyme expression strain are well known in the art and can be performed by individuals skilled in the relevant art without undue experimentation.

Production of Recombinant gtfJ in Fermentation

Production of the recombinant gtfJ enzyme in a fermenter was initiated by preparing a pre-seed culture of the *E. coli* strain MG1655/pMP52, expressing the gtfJ enzyme, constructed as described infra. A 10 mL aliquot of the seed medium was added into a 125 mL disposable baffled flask and was inoculated with a 1.0 mL culture of *E. coli* MG1655/pMP52 in 20% glycerol. This culture was allowed to grow at 37° C. while shaking at 300 revolutions per minute (rpm) for 3 hours.

A seed culture, for starting the fermenter, was prepared by charging a 2 L shake flask with 0.5 L of the seed medium. 1.0 mL of the pre-seed culture was aseptically transferred into 0.5 L seed medium in the flask and cultivated at 37° C. and 300 rpm for 5 hours. The seed culture was transferred at optical density 550 nm ($OD_{550}$)>2 to a 14 L fermenter (Braun, Perth Amboy, N.J.) containing 8 L of the fermenter medium described above at 37° C.

Cells of *E. coli* MG1655/pMP52 were allowed to grow in the fermenter and glucose feed (50% w/w glucose solution containing 1% w/w $MgSO_4.7H_2O$) was initiated when glucose concentration in the medium decreased to 0.5 g/L. The feed was started at 0.36 grams feed per minute (g feed/min) and increased progressively each hour to 0.42, 0.49, 0.57, 0.66, 0.77, 0.90, 1.04, 1.21, 1.41 1.63, 1.92, 2.2 g feed/min respectively. The rate was held constant afterwards by decreasing or temporarily stopping the glucose feed when glucose concentration exceeded 0.1 g/L. Glucose concentration in the medium was monitored using a YSI glucose analyzer (YSI, Yellow Springs, Ohio).

Induction of glucosyltransferase enzyme activity was initiated, when cells reached an $OD_{550}$ of 70, with the addition of 9 mL of 0.5 M IPTG (isopropyl β-D-1-thiogalacto-pyranoside). The dissolved oxygen (DO) concentration was controlled at 25% of air saturation. The DO was controlled first by impeller agitation rate (400 to 1200 rpm) and later by aeration rate (2 to 10 standard liters per minute, slpm). The pH was controlled at 6.8. $NH_4OH$ (14.5% weight/volume, w/v) and $H_2SO_4$ (20% w/v) were used for pH control. The back pressure was maintained at 0.5 bars. At various intervals (20, 25 and 30 hours), 5 mL of Suppressor 7153 antifoam was added into the fermenter to suppress foaming. Cells were harvested by centrifugation 8 hours post IPTG addition and were stored at −80° C. as a cell paste.

Preparation of gtfJ Crude Enzyme Extract from Cell Paste

The cell paste obtained above was suspended at 150 g/L in 50 mM potassium phosphate buffer pH 7.2 to prepare a slurry. The slurry was homogenized at 12,000 psi (Rannie-type machine, APV-1000 or APV 16.56) and the homogenate chilled to 4° C. With moderately vigorous stirring, 50 g of a floc solution (Aldrich no. 409138, 5% in 50 mM sodium phosphate buffer pH 7.0) was added per liter of cell homogenate. Agitation was reduced to light stirring for 15 minutes. The cell homogenate was then clarified by centrifugation at 4500 rpm for 3 hours at 5-10° C. Supernatant, containing crude gtfJ enzyme extract, was concentrated (approximately 5×) with a 30 kilo Dalton (kDa) cut-off membrane. The concentration of protein in the gftJ enzyme solution was determined by the bicinchoninic acid (BCA) protein assay (Sigma Aldrich) to be 4-8 g/L.

Enzymatic Synthesis of Poly(α(1→3) Glucan)

Several batches of poly(α(1→3) glucan) polymer were prepared by combining the materials listed in Table 1 in the amounts shown. The pH was adjusted to pH 6.8-7.0 by addition of 10% KOH. De-ionized water was then added to bring the volume up to level specified in Table 1. The buffer concentration in the thus prepared solution was 50 mM.

The thus prepared pH-adjusted solution was then charged with the enzyme extract prepared supra in an amount sufficient to bring the enzyme concentration to 0.30% by weight in each batch. Each thus prepared reaction mixture was then allowed to stand at ambient temperature for 144 hours. The resulting poly(α(1→3) glucan) solids were collected on a Buchner funnel using a 325 mesh screen over 40 micron filter paper. The filter cake was re-suspended in deionized water and filtered twice more as above to remove sucrose, fructose and other low molecular weight, soluble by-products. Finally two additional washes with methanol were carried out, the filter cake was pressed out thoroughly on the funnel and dried in vacuum at room temperature, yielding a white flaky solid in the amounts shown in Table 1.

TABLE 1

| Batch Number | Batch size (L) | Sucrose (g) | Dextran T-10 (g) | KH2PO4 Buffer (mL) | Ethanol (mL) | Yield |
|---|---|---|---|---|---|---|
| 1 | 20 | 1000 | 4.0 | 1000 | 0 | 120.0 |
| 2 | 20 | 1000 | 4.0 | 1000 | 0 | 114.5 |
| 3 | 20 | 1000 | 4.0 | 1000 | 0 | 113.0 |

TABLE 1-continued

| Batch Number | Batch size (L) | Sucrose (g) | Dextran T-10 (g) | KH2PO4 Buffer (mL) | Ethanol (mL) | Yield |
|---|---|---|---|---|---|---|
| 4 | 20 | 1000 | 4.0 | 1000 | 0 | 86.0 |
| 5 | 3 | 450 | 2.4 | 150 | 150 | 47.3 |
| 6 | 3 | 450 | 3.0 | 150 | 300 | 32.1 |
| 7 | 3 | 450 | 6.0 | 150 | 300 | 49.0 |
| 8 | 3 | 450 | 9.0 | 150 | 300 | 56.6 |

Preparation of 1,3 Alpha Glucan Triacetate

The several batches of poly(α(1→3) glucan) as shown in Table 1 were combined in the amounts shown, respectively, in Table 2 to make three 130 g blends for subsequent acetylation.

The blends were boiled for one hour in deionized water. Each thus boiled blend was then added to a mixture containing 890 mL of methylene chloride, 600 mL of acetic acid and 870 mL of acetic anhydride in a 4 L reaction kettle provided with a nitrogen blanket. Mixing was effected with an egg beater style mixing blade that covered the entire depth of the liquid. The resulting mixture was then cooled to approximately −5° C. Separately, a catalyst mixture was prepared by addition of 9 mL of 70% aqueous perchloric acid to 370 mL of chilled acetic anhydride. The catalyst mixture was then added dropwise to the rapidly stirred reaction mixture at −5° C. Subsequent to catalyst addition, the reaction kettle was immersed in a hot water bath contained in a 2 gallon plastic bucket, and heated to 30° C. When the temperature of the reactants was observed to exceed 32° C., the reaction kettle was removed from the hot water bath and suspended in the air until the reaction temperature was observed to reach 27° C. at which point the reaction kettle was again immersed in the hot water bath. This procedure was continued for a period of 2-4 hours until reaction was complete. The reaction was deemed to be complete when no particulate matter was observed by visual inspection of the translucent reaction mixture.

In small aliquots, the mixture was coagulated in methanol in a Waring blender, the resultant suspension was filtered, washed with methanol twice more, water washed until neutral pH was obtained, and then washed with methanol and dried under vacuum. Yield of the resulting triacetate is shown in Table 2

TABLE 2

| Blend | Polymer Batches | Wt. (g) | Triacetate Yield (g) |
|---|---|---|---|
| 1 | 1/2 | 30/100 | 190.4 |
| 2 | 3/4 | 43.7/86.3 | 204.6 |
| 3 | 5/6/7/8 | 25/20/40/45 | 207.94 |

Spinning Solution

Spinning solutions A and B were prepared from the thus prepared acetylated poly(α(1→3) glucan). 100 parts by weight of trifluoroacetic acid were diluted with 8 parts by weight of water. The thus prepared solution was added to two 1-quart zip-lock bags, each containing 120 g of the respective acetylate poly(α(1→3) glucan) blends, as indicated in Table 3, in an amount sufficient to prepare a 37.5% solids solution in each case. Each bag was then sealed, and was subject to hand kneading to homogenize. The bag was allowed to stand at ambient conditions overnight. In order to dissolve the polymer therein, the mixture of polymer and solvent was first stirred by hand using a stainless steel spatula in order to homogenize the mixture. The homogenized mixture was then pumped back and forth through 13 cycles between two syringes connected by a short length of 3 mm ID stainless steel tubing.

TABLE 3

| Spinning | Glucan Triacetate Blend | |
|---|---|---|
| Solution | # | Weight (g) |
| A | 1 | 94 |
| | 2 | 26 |
| B | 3 | 120 |

Fiber Spinning of Glucan Triacetate

The thus prepared spinning solutions were solution-spun into continuous filaments using the spinning apparatus depicted in FIG. 1. The spinning solution was charged to the cell (13) that was provided with a piston (11) connected to ram (12) which pushed solution through a spin pack containing a screen pack (14) provided with stainless steel support screens including 100 mesh support screen and a 325 mesh filter screen, and a 20-hole spinneret (15). Each spinneret hole was characterized by a diameter of 0.005 in. and a length to diameter ratio of 6. The piston (11) was driven by a drive screw (not shown) that drove the ram at a metered rate. The filaments (16) emerging from the spinneret (15) were directed into a coagulation bath (17) consisting of 100% methanol. The fiber was passed around Teflon guide pins (18) within the coagulation bath and exiting the bath to a traverse (19) with a guide pin (110) distributing the fiber evenly across a width to a windup (111) where the fiber is collected on a bobbin. The bobbins so prepared were soaked overnight in methanol. Spinning conditions are provided in Table 4. The yarns so produced are herein designated GYA-1 and GYA-2.

TABLE 4

| | Spinning Solution | Jet Velocity (fpm) | Bath Temp (° C.) | Bath length (ft) | Air Gap (in) | Wind up speed (fpm) | Spin Stretch Factor |
|---|---|---|---|---|---|---|---|
| GYA-1 | A | 17 | −1 | 11.8 | 0.3 | 52 | 3.1 |
| GYA-2 | B | 22 | −19 | 11.8 | 0.75 | 60 | 2.7 |

Saponification 0.54 g of sodium methoxide were added to 100 mL of methanol. The bobbin of GYA-2 yarn was placed into the solution so formed for a period of 48 hours to regenerate glucan fiber from the glucan triacetate fiber. The so-treated bobbin was then rinsed with methanol, and soaked for an additional 24 hours in neat methanol, and allowed to air dry. The resulting regenerated glucan fiber yarn is herein designated GY-1.

Oxidation Treatment

Figure 2:
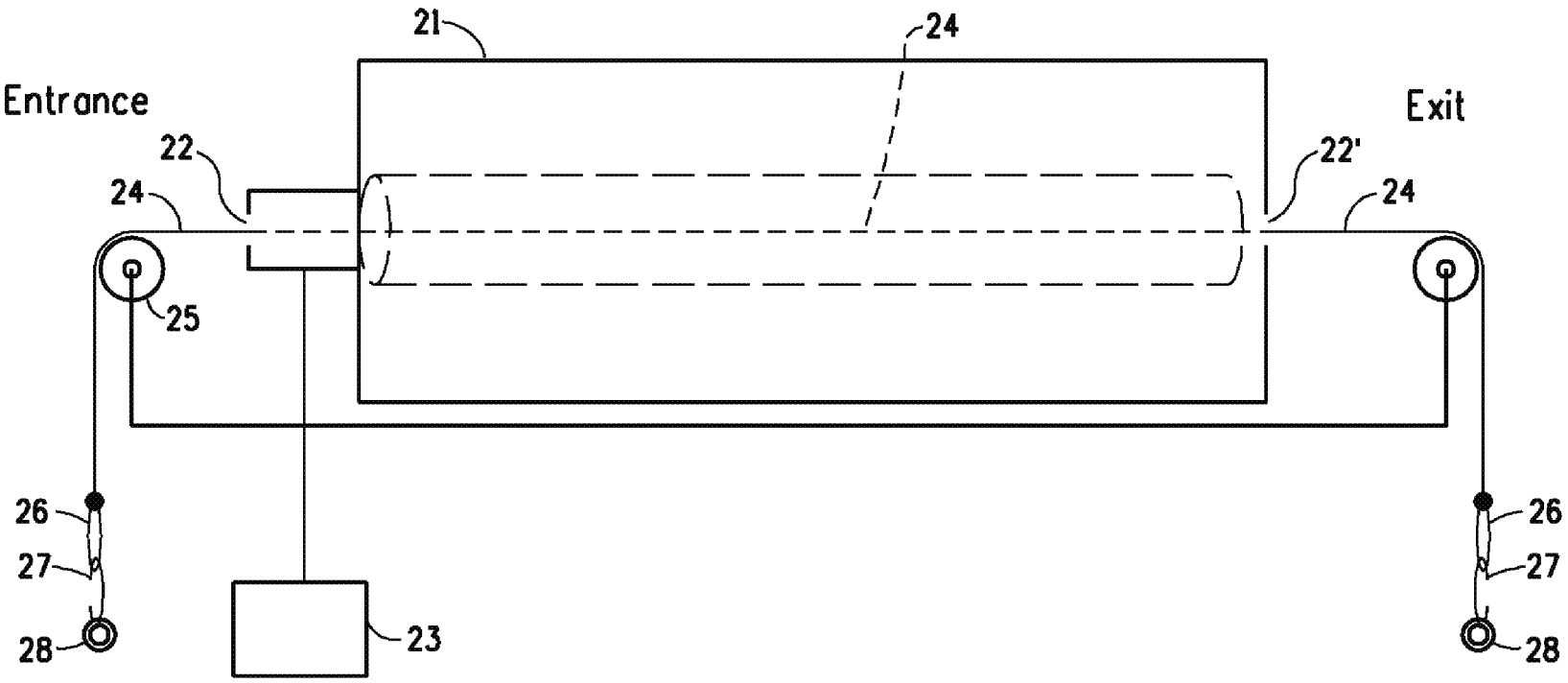
FIG. 2 depicts a side view of the tube furnace arrangement used in the thermal stabilization step of the process hereof as executed in the specific embodiments thereof.

Referring to FIG. 2, a tube furnace (21) having an entry port (22) and an exit port (22') was equipped with an air supply fan (23) that flowed air, at rates stated in Table 5, infra, into the entry port (22) and through the furnace to the exit port (22'). A skein of fiber (24) was fed end-wise through the tube furnace. The skein was disposed to pass over a pulley (25) at each end of the tube furnace. Each end of the skein was formed into a loop (26), through which a hook (27) was passed. Affixed to the hook was a weight (28). The weight employed is stated in the examples, infra. The heated section of the tube inside the tube furnace was a 2 inch schedule 5 tube with an inner diameter of 57 mm and a length of 54 inches. Each specimen was subject to a temperature of 180° C. in air for 10 minutes. The temperature was then increased in a series of steps, as described in the thermal profile provided in the examples, infra. It took less than 1 minute to make the temperature changes between adjacent steps in the thermal profile.

Carbonization Treatment

Figure 3:
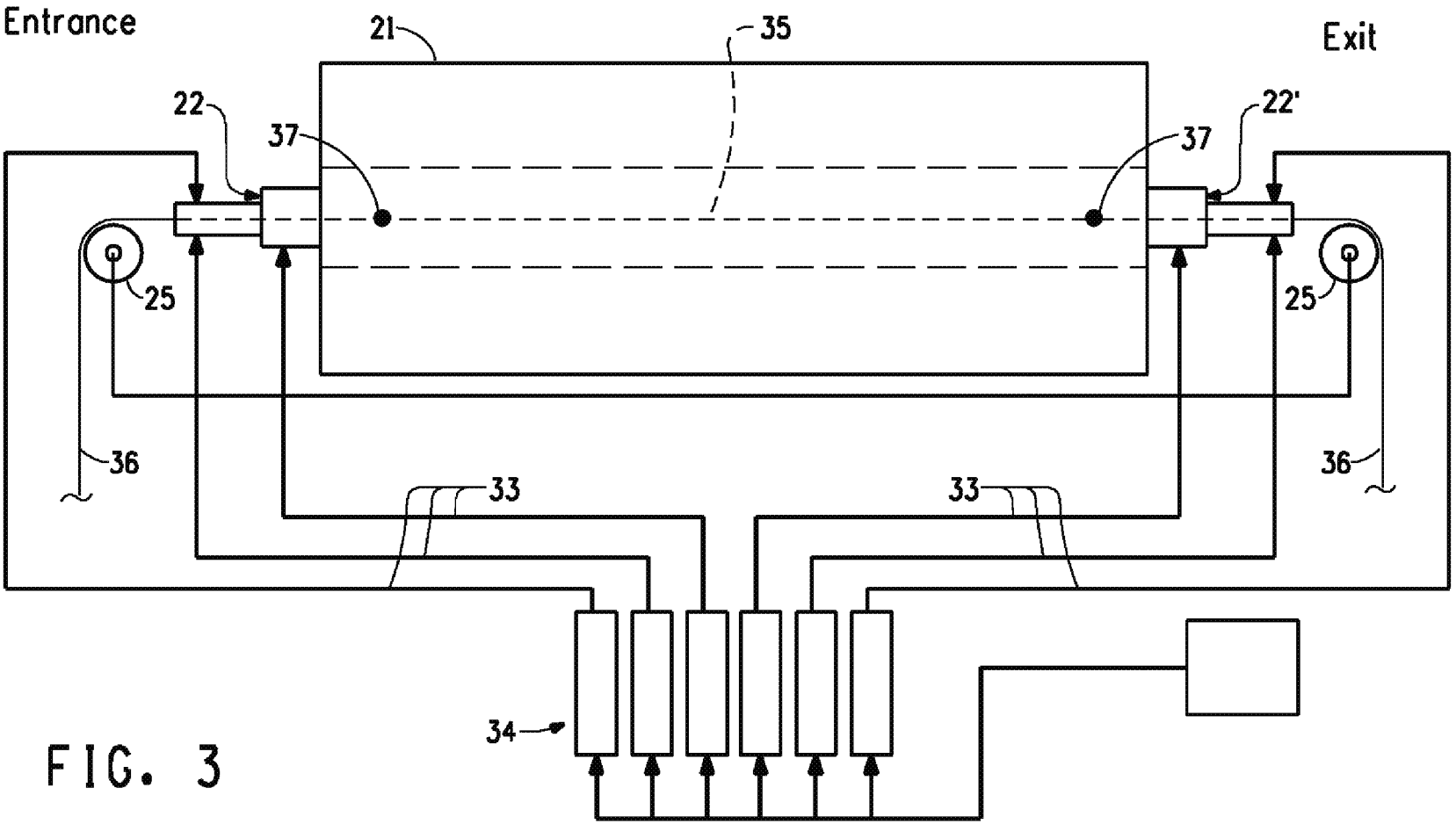
FIG. 3 depicts a side view of the carbonization apparatus used in the specific embodiments hereof.

Referring to FIG. 3, nitrogen was provided to the tube furnace (21) at six locations (33): one at the entry port (22) and one at the exit port (22') of the tube furnace, two at the tubing before the entrance port and two at the tubing before the exit port (22'). The nitrogen was fed through six flow meters (34). The oxidized fiber skein (35) was attached to an Inconel® transport wire 0.9 mm in diameter (36) using metal crimps (37) in order to keep the fiber skein in a zero tension state. The Inconel® wire was wrapped around pulleys (25) located at the entry port (22) and exit port (22') in order to move the fiber skein into and out of the furnace. The fiber skein thus disposed was then subject to heating according to the schedule disclosed in the specific embodiments infra.

Preparation of Filament Skeins.

Figure 4B:
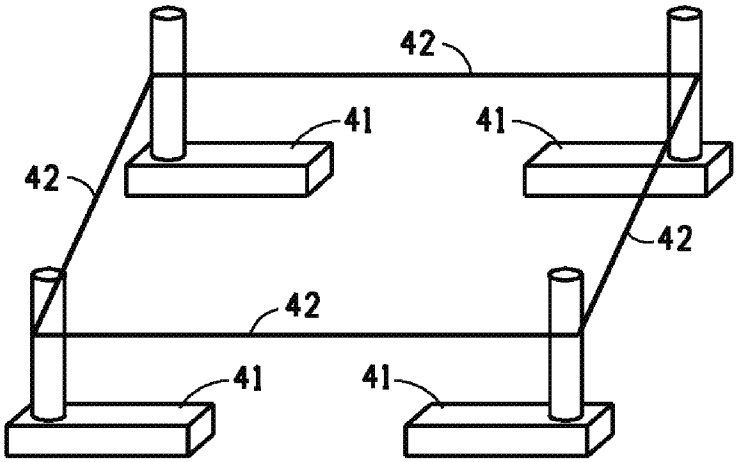
FIG. 4B depicts a front view of the winding frame used to prepare the filament skeins employed in the specific embodiments hereof.
Figure 4A:
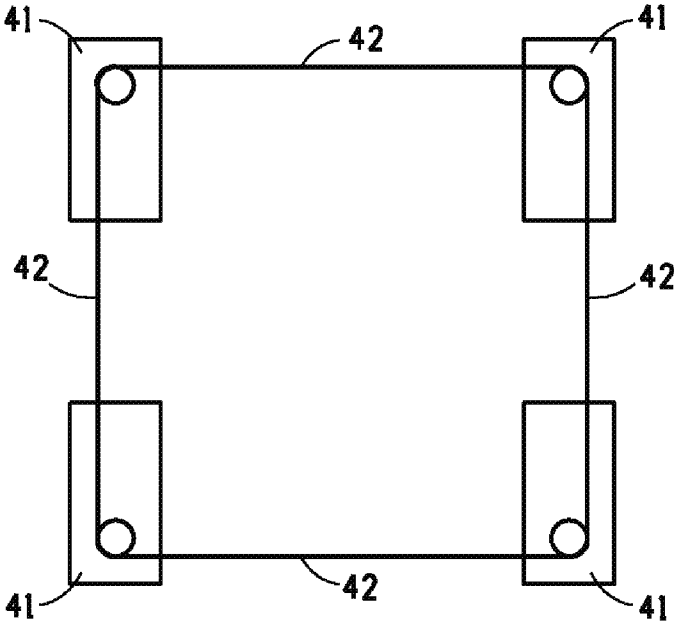
FIG. 4A depicts a top view.

Referring to FIG. 4, a skein of filaments having more than 20 ends was prepared by winding the skein around four posts (41) that were set at the corners of a square (42), 24 inches apart from each other. A fiber skein was wrapped around the posts until the skein contained the desired number of filaments. The skein was cut at one post, resulting in a length of 8 feet.

Example 1

Two 60-inch skeins, consisting each of 20 filaments of GY-1 were prepared for oxidation as described supra. To each skein, herein designated GY-1-A and GY-1-B, a 3.5-gram weight was affixed at each end as shown in FIG. 2. Under an air flow rate of 6 standard cubic feet per minute (scfm), each skein was individually heated to 230° C., held for 60 minutes, then heated to 250° C., held for 60 minutes, then heated to 270° C., held for 60 minutes, then heated to 290° C., held for 60 minutes, then heated to 310° C., held for 60 minutes. No breakage had occurred at the end of the five-hour thermal exposure process. The resulting oxidized skeins are herein designated GY-1-AO and GY-1-BO.

The GY-1-AO oxidized skein was prepared for carbonization as described supra. The skein was heated at 800° C. for 90 seconds under a nitrogen purge of 120 scfh. The skein, herein designated GY-1-AC, was removed from the oven and spooled. The skein was black in color, pliable enough to be spooled, but fragile. If the skein was wrapped tightly, filaments would break.

The GY-1-BO oxidized skein was prepared for carbonization as described supra. The skein was heated to 1000° C. for 90 seconds under a nitrogen purge of 120 scfh. The skein was black in color. The filaments seemed stronger than GY-1-AC, but upon removal from the oven, many filaments were caught on the equipment and broken.

Example 2

Referring to FIG. 4, a 440 filament skein was prepared by wrapping a 20-filament length of GY-1 around the posts 22 times. A second skein was prepared in the same manner. The skeins so prepared were cut at one post, resulting in two lengths of 8 feet each, designated GY-1-C and GY-1-D.

Each of GY-1-C and GY-1-D were prepared for oxidation as described, supra. Each was oxidized separately. To each skein a 50-gram weight was affixed at each end as shown in FIG. 2. Under an air flow rate of 10 scfm, each skein was heated to 250° C., held for 40 minutes, then heated to 270° C., held for 40 minutes, then heated to 290° C., held for 40 minutes, then heated to 310° C., held for 40 minutes, then heated to 330° C., held for 40 minutes. No breakage occurred at the end of the 200-minute temperature profile. The resulting oxidized skeins are herein designated GY-1-CO and GY-1-DO.

c. Carbonization

Oxidized skein GY-1-CO was prepared for carbonization as described supra. The skein was heated to 800° C. under a nitrogen flow rate of 120 standard scfh for 120 seconds. The thus heated skein, herein designed GY-1-CC, was removed from the furnace. The skein was black in color, pliable, and easy to spool.

Oxidized skein GY-1-DO was treated in a manner identical to that of GY-1-CO except that the temperature was 1000° C. The thus heated skein, herein designed GY-1-DC, was removed from the furnace. The skein was black in color, very pliable, and very easy to spool.

In the thus carbonized skeins fiber diameter was determined by scanning electron microscopy; denier, using a Tex-Techno Vibromat ME denier testerand (TexTechno H.Stein GMBH & Co.); and, mechanical properties, using an Instron® Universal Testing Machine. Results are shown in Table 5.

TABLE 5

| | GY-1-CC | GY-1-CD |
|---|---|---|
| Diameter (micrometers) | 17.0 ± 0.4 | 19.6 ± 1.7 |
| Denier | 3.581 ± 0.789 | 3.076 ± 0.674 |
| Tenacity (gpd) | 1.3 ± 0.5 | 2.0 ± 1.0 |
| Tensile Strength (MPa) | 189 ± 79 | 203 ± 100 |
| Tensile Modulus (GPa) | 28 ± 4 | 27 ± 6 |

Comparative Example A

One 60-inch skein consisting of 20 filaments of glucan triacetate GYA-1 was prepared for oxidation as described supra. A 4.5 g weight was affixed to each end of the skein as shown in FIG. 2. Under an air flow rate of 6 scfm, the bundle was heated to 230° C. After one minute, the skein broke.

Comparative Example B

Two 200 filament skeins were prepared by wrapping the 20-filament glucan triacetate GYA-1 ten times around the posts of the apparatus in FIG. 4. Each skein was cut at one post, resulting in two lengths of 8 feet.

A 60-inch skein was cut from each of the thus prepared 8 foot lengths, herein designated GYA-1-1 and GYA-1-2. Each 60-inch skein was prepared for oxidation as described supra. Each skein was oxidized separately. A 16 g weight was affixed to each end of the GYA-1-1 skein, and a 40 g weight was affixed to each end of GYA-1-2. The skeins were heated for 10 minutes at 180° C. under an air flow rate of 6 scfm. skeins broke after 10 minutes at 180° C.

Comparative Example C

PANOX® Thermally Stabilized Textile Fiber, an oxidized poly(acrylonitrile) fiber was obtained from The SGL Group, Ross-Shire, UK. Three PANOX fiber skeins, herein designated PANOX-1, PANOX-2, and PANOX-3, consisting of approximately 12,000 filaments per skein were prepared for carbonization as described supra. Three 60-inch length skeins were heated to 800° C. under a nitrogen atmosphere of 120 scfh. PANOX-1 was held for 60 seconds, PANOX-2 was held for 90 seconds, PANOX-3 was held for 120 seconds. PANOX-1 caught on the furnace during removal and was bunched up. No further testing was performed. PANOX-2 was frayed and could not be spooled. PANOX-3 was removed from the oven, herein designed PANOXC-3, and spooled.

A further 12,000 filament 60 inch skein of PANOX, herein designated PANOX-4, was heated to 1000° C. under a nitrogen atmosphere of 120 scfh for 120 seconds. PANOX-4 was removed from the oven, herein designated PANOXC-4 and spooled.

PANOXC-3 and PANOXC-4 were analyzed in the manner of the specimens in Example 2. Results are shown in Table 6.

TABLE 6

| | PANOXC-3 | PANOXC-4 |
|---|---|---|
| Diameter (micrometers) | 8.0 ± 0.3 | 9.9 ± 0.3 |
| Denier | 0.779 ± 0.040 | 1.111 ± 0.070 |
| Tenacity (gpd) | 9.4 ± 2.1 | 2.7 ± 1.7 |
| Tensile Strength (MPa) | 1440 ± 317 | 387 ± 247 |
| Tensile Modulus (GPa) | 85 ± 6 | 15 ± 8 |

SEQUENCE LISTING

```
<160> NUMBER OF SEQ ID NOS: 3

<210> SEQ ID NO 1
<211> LENGTH: 4434
<212> TYPE: DNA
<213> ORGANISM: artificial sequence
<220> FEATURE:
<223> OTHER INFORMATION: codon-optimized gtfj gene from Streptococcus
      salivarius

<400> SEQUENCE: 1

atggacgaaa cgcaggataa gaccgtgacg cagagcaaca gcggcaccac cgcttccctg     60

gtcactagcc ctgaagccac gaaagaggcg gacaaacgca cgaacactaa agaggccgac    120

gttctgacgc ctgcaaaaga aacgaacgca gtcgagactg cgaccaccac taacacccag    180

gcgacggcgg aggccgccac gaccgcgacc accgcggacg tcgcggtggc tgcggtgccg    240
```

-continued

```
aacaaagaag cggtcgttac cacggatgct ccggcggtca cgaccgagaa agcggaagaa    300
cagccggcta ccgttaaagc agaagtcgtc aatacggaag tgaaagcgcc ggaagcggct    360
ctgaaagaca gcgaggttga ggcagcgctg agcctgaaga acatcaagaa cattgatggc    420
aagtattact atgttaatga ggatggcagc cacaaagaga atttcgctat taccgtgaat    480
ggccagctgc tgtactttgg taaagacggt gcgctgacgt cctctagcac gtattctttt    540
accccaggca ctaccaatat cgtggacggt tttagcatta acaaccgcgc ttacgacagc    600
agcgaggcga gctttgagct gatcgacggt tacttgaccg cagacagctg gtatcgtccg    660
gctagcatca tcaaagatgg tgttacgtgg caagcgtcca ccgccgagga ttttcgtccg    720
ctgctgatgg catggtggcc gaatgtggat acgcaggtga actatttgaa ttacatgtcc    780
aaagttttca acctggacgc gaaatactct agcaccgaca aacaggaaac cctgaaagtg    840
gcagcaaaag acattcaaat caagattgaa caaaagattc aagcggagaa gagcacgcag    900
tggctgcgtg aaactatcag cgcctttgtg aaaacccagc cgcagtggaa caaagaaacc    960
gagaattaca gcaagggtgg tggtgaggac cacctgcaag gtggcgcact gctgtatgtt   1020
aacgacagcc gtaccccttg ggcgaatagc gattaccgtc gtctgaatcg caccgcaacc   1080
aatcagacgg gcacgatcga taagtctatt ctggacgagc agtctgaccc aaaccacatg   1140
ggcggtttcg actttctgct ggcgaacgac gtcgacctga gcaatccggt cgtgcaggct   1200
gagcagctga atcaaatcca ctatctgatg aattggggtt ccattgtgat gggtgacaag   1260
gatgcgaact ttgacggcat tcgtgtcgat gcagttgaca acgtggacgc ggacatgttg   1320
caactgtata ccaattactt ccgtgagtac tacggtgtga acaagagcga agctaacgca   1380
ctggctcaca tcagcgttct ggaggcgtgg agcctgaatg ataatcatta caatgacaag   1440
accgatggtg cggcactggc aatggagaat aagcaacgtc tggcgctgtt gttttcgttg   1500
gcgaaaccga tcaaagagcg taccccggca gtgagcccgc tgtataacaa caccttcaat   1560
accacccagc gtgatgaaaa gaccgattgg attaacaaag acggtagcaa ggcttacaac   1620
gaagatggca cggtcaaaca atcgaccatc ggtaagtaca acgagaaata cggtgacgca   1680
tccggtaact acgttttcat ccgtgcccac gataacaacg tccaggacat catcgccgag   1740
atcatcaaga aagagatcaa cccgaaaagc gacggcttca ccatcaccga cgccgaaatg   1800
aagcaagcct ttgaaatcta taacaaagat atgctgtcga gcgacaaaaa gtataccctg   1860
aataacattc cggcagcgta tgccgtgatg ttgcagaata tggaaacgat tacccgcgtc   1920
tattacggtg atctgtatac ggacgacggt cactacatgg aaaccaaatc tccgtattac   1980
gataccatcg tgaatttgat gaagagccgt atcaagtatg tttcgggtgg ccaggcgcaa   2040
cgtagctatt ggctgccgac cgacggtaag atggacaata gcgacgttga gctgtaccgc   2100
acgaatgagg tttacacgag cgtgcgctat ggtaaggata tcatgaccgc taatgatacc   2160
gaaggctcta agtattcccg caccagcggc caagtcacct tggtcgcgaa caatccgaag   2220
ctgaatctgg accaaagcgc caagttgaat gtggagatgg gcaaaatcca tgcgaatcag   2280
aagtatcgcg cactgattgt cggcactgcg gacggcatta agaactttac ttccgacgcg   2340
gacgccattg cagcgggtta tgtgaaagaa accgatagca acggcgtgct gaccttcggt   2400
gctaacgaca ttaagggcta cgaaacgttt gatatgagcg gtttcgtggc ggtgtgggtt   2460
ccggtgggtg catctgacaa tcaggacatt cgtgttgcgc cgagcaccga ggcaaagaaa   2520
gaaggtgagc tgaccttgaa ggcgacggaa gcgtatgata gccagctgat ttacgaaggc   2580
tttagcaatt tccagacgat cccagatggc agcgatccgt ccgtgtatac gaaccgcaag   2640
```

```
attgcggaga acgtggatct gttcaaaagc tggggtgtca ccagctttga gatggcaccg   2700
caatttgtct cggcggatga tggcaccttt ctggatagcg ttattcagaa tggctacgcc   2760
ttcgccgacc gttatgacct ggccatgtcc aagaacaaca agtatggtag caaagaggac   2820
ctgcgtgatg cactgaaagc actgcataag gcgggtattc aagctatcgc agactgggtt   2880
ccagaccaga tctaccagct gccgggcaaa gaagttgtca ccgccacccg tacggatggt   2940
gctggccgta agatcgcaga cgcgattatc gaccattctc tgtatgttgc aaacagcaaa   3000
agcagcggca aagattatca agcaaagtac ggtggcgagt tcctggccga gctgaaagcc   3060
aaatacccgg aaatgttcaa agttaacatg attagcacgg gtaagccgat tgatgactcc   3120
gtgaaattga agcaatggaa agccgagtac ttcaatggca ccaacgtttt ggaacgtggt   3180
gtcggctatg ttctgagcga cgaggcgacc ggtaagtatt tcacggtgac caaagaaggc   3240
aatttcattc cgctgcaact gacgggtaaa gagaaagtta tcacgggttt ctccagcgat   3300
ggtaagggta tcacctattt cggtacgagc ggtacgcagg cgaagtctgc gtttgttacc   3360
ttcaatggta acacctacta tttcgacgcg cgtggccaca tggttaccaa tagcgaatac   3420
agcccgaatg gcaaggacgt ctaccgtttt ctgccgaacg gtatcatgct gagcaatgcg   3480
ttttacattg atgcgaacgg taatacctac ctgtacaact ctaagggtca aatgtacaaa   3540
ggcggttaca cgaaattcga tgtttctgaa acggataagg acggtaaaga gtccaaggtc   3600
gtcaagttcc gctactttac gaacgaaggc gtcatggcca agggtgttac cgtcattgat   3660
ggttttaccc aatacttcgg tgaggacggc tttcaagcga aggataagct ggtcaccttc   3720
aagggcaaga cgtattactt cgacgcacac actggtaatg gtatcaaaga tacctggcgc   3780
aatatcaatg gtaaatggta ctatttcgac gcgaatggcg ttgctgcgac cggtgcgcag   3840
gtgattaacg gccagaaact gtacttcaac gaggatggct cccaagtcaa aggcggcgtg   3900
gttaagaacg cagacggcac ctatagcaaa tacaaagaag gttttggtga gctggttact   3960
aacgagtttt tcacgactga tggcaatgtt tggtactacg ccggtgcaaa tggtaaaacc   4020
gttaccggtg cacaagtgat caacggccaa catttgtact tcaatgcgga cggttcccag   4080
gtgaagggtg gcgttgtcaa gaacgcggat ggcacctaca gcaagtacaa tgctagcact   4140
ggtgaacgtc tgacgaacga gttctttacg accggtgata acaattggta ttacattggc   4200
gcaaacggta agagcgtgac gggtgaggtc aagattggtg atgatactta ctttttcgcg   4260
aaggatggca aacaagttaa aggtcaaacc gtcagcgccg gtaatggtcg cattagctac   4320
tactacggtg acagcggcaa gcgtgcggtt agcacctgga ttgagattca gccgggtgtt   4380
tatgtgtatt tcgacaaaaa cggtttggcg taccctccgc gtgttctgaa ttaa         4434
```

<210> SEQ ID NO 2
<211> LENGTH: 8455
<212> TYPE: DNA
<213> ORGANISM: artificial sequence
<220> FEATURE:
<223> OTHER INFORMATION: plasmid pMP52

<400> SEQUENCE: 2

```
ctcatgacca aaatccctta acgtgagtta cgcgcgcgtc gttccactga gcgtcagacc     60
ccgtagaaaa gatcaaagga tcttcttgag atcctttttt tctgcgcgta atctgctgct    120
tgcaaacaaa aaaaccaccg ctaccagcgg tggtttgttt gccggatcaa gagctaccaa    180
ctctttttcc gaaggtaact ggcttcagca gagcgcagat accaaatact gttcttctag    240
tgtagccgta gttagcccac cacttcaaga actctgtagc accgcctaca tacctcgctc    300
```

-continued

```
tgctaatcct gttaccagtg gctgctgcca gtggcgataa gtcgtgtctt accgggttgg    360
actcaagacg atagttaccg gataaggcgc agcggtcggg ctgaacgggg ggttcgtgca    420
cacagcccag cttggagcga acgacctaca ccgaactgag atacctacag cgtgagctat    480
gagaaagcgc cacgcttccc gaagggagaa aggcggacag gtatccggta agcggcaggg    540
tcggaacagg agagcgcacg agggagcttc caggggggaaa cgcctggtat ctttatagtc    600
ctgtcgggtt tcgccacctc tgacttgagc gtcgattttt gtgatgctcg tcaggggggc    660
ggagcctatg gaaaaacgcc agcaacgcgg cctttttacg gttcctggcc ttttgctggc    720
cttttgctca catgttcttt cctgcgttat cccctgattc tgtggataac cgtattaccg    780
cctttgagtg agctgatacc gctcgccgca gccgaacgac cgagcgcagc gagtcagtga    840
gcgaggaagc ggaaggcgag agtagggaac tgccaggcat caaactaagc agaaggcccc    900
tgacggatgg cctttttgcg tttctacaaa ctctttctgt gttgtaaaac gacggccagt    960
cttaagctcg ggccccctgg gcggttctga taacgagtaa tcgttaatcc gcaaataacg   1020
taaaaacccg cttcggcggg tttttttatg gggggagttt agggaaagag catttgtcag   1080
aatatttaag ggcgcctgtc actttgcttg atatatgaga attatttaac cttataaatg   1140
agaaaaaagc aacgcacttt aaataagata cgttgctttt tcgattgatg aacacctata   1200
attaaactat tcatctatta tttatgattt tttgtatata caatatttct agtttgttaa   1260
agagaattaa gaaaataaat ctcgaaaata ataaagggaa aatcagtttt tgatatcaaa   1320
attatacatg tcaacgataa tacaaaatat aatacaaact ataagatgtt atcagtattt   1380
attatgcatt tagaataaat tttgtgtcgc ccttaattgt gagcggataa caattacgag   1440
cttcatgcac agtgaaatca tgaaaaattt atttgctttg tgagcggata acaattataa   1500
tatgtggaat tgtgagcgct cacaattcca caacggtttc cctctagaaa taattttgtt   1560
taacttttga attctctaga ggaaggtaaa acatatggac gaaacgcagg ataagaccgt   1620
gacgcagagc aacagcggca ccaccgcttc cctggtcact agccctgaag ccacgaaaga   1680
ggcggacaaa cgcacgaaca ctaaagaggc cgacgttctg acgcctgcaa aagaaacgaa   1740
cgcagtcgag actgcgacca ccactaacac ccaggcgacg gcggaggccg ccacgaccgc   1800
gaccaccgcg gacgtcgcgg tggctgcggt gccgaacaaa gaagcggtcg ttaccacgga   1860
tgctccggcg gtcacgaccg agaaagcgga agaacagccg gctaccgtta aagcagaagt   1920
cgtcaatacg gaagtgaaag cgccggaagc ggctctgaaa gacagcgagg ttgaggcagc   1980
gctgagcctg aagaacatca agaacattga tggcaagtat tactatgtta atgaggatgg   2040
cagccacaaa gagaatttcg ctattaccgt gaatggccag ctgctgtact ttggtaaaga   2100
cggtgcgctg acgtcctcta gcacgtattc ttttacccca ggcactacca atatcgtgga   2160
cggttttagc attaacaacc gcgcttacga cagcagcgag gcgagctttg agctgatcga   2220
cggttacttg accgcagaca gctggtatcg tccggctagc atcatcaaag atggtgttac   2280
gtggcaagcg tccaccgccg aggattttcg tccgctgctg atggcatggt ggccgaatgt   2340
ggatacgcag gtgaactatt tgaattacat gtccaaagtt ttcaacctgg acgcgaaata   2400
ctctagcacc gacaaacagg aaaccctgaa agtggcagca aaagacattc aaatcaagat   2460
tgaacaaaag attcaagcgg agaagagcac gcagtggctg cgtgaaacta tcagcgcctt   2520
tgtgaaaacc cagccgcagt ggaacaaaga aaccgagaat tacagcaagg gtggtggtga   2580
ggaccacctg caaggtggcg cactgctgta tgttaacgac agccgtaccc cttgggcgaa   2640
tagcgattac cgtcgtctga atcgcaccgc aaccaatcag acgggcacga tcgataagtc   2700
```

-continued

```
tattctggac gagcagtctg acccaaacca catgggcggt ttcgactttc tgctggcgaa   2760
cgacgtcgac ctgagcaatc cggtcgtgca ggctgagcag ctgaatcaaa tccactatct   2820
gatgaattgg ggttccattg tgatgggtga caaggatgcg aactttgacg gcattcgtgt   2880
cgatgcagtt gacaacgtgg acgcggacat gttgcaactg tataccaatt acttccgtga   2940
gtactacggt gtgaacaaga gcgaagctaa cgcactggct cacatcagcg ttctggaggc   3000
gtggagcctg aatgataatc attacaatga caagaccgat ggtgcggcac tggcaatgga   3060
gaataagcaa cgtctggcgc tgttgttttc gttggcgaaa ccgatcaaag agcgtacccc   3120
ggcagtgagc ccgctgtata acaacacctt caataccacc cagcgtgatg aaaagaccga   3180
ttggattaac aaagacggta gcaaggctta caacgaagat ggcacggtca aacaatcgac   3240
catcggtaag tacaacgaga aatacggtga cgcatccggt aactacgttt tcatccgtgc   3300
ccacgataac aacgtccagg acatcatcgc cgagatcatc aagaaagaga tcaacccgaa   3360
aagcgacggc ttcaccatca ccgacgccga aatgaagcaa gcctttgaaa tctataacaa   3420
agatatgctg tcgagcgaca aaaagtatac cctgaataac attccggcag cgtatgccgt   3480
gatgttgcag aatatggaaa cgattacccg cgtctattac ggtgatctgt atacggacga   3540
cggtcactac atggaaacca aatctccgta ttacgatacc atcgtgaatt tgatgaagag   3600
ccgtatcaag tatgtttcgg gtggccaggc gcaacgtagc tattggctgc cgaccgacgg   3660
taagatggac aatagcgacg ttgagctgta ccgcacgaat gaggtttaca cgagcgtgcg   3720
ctatggtaag gatatcatga ccgctaatga taccgaaggc tctaagtatt cccgcaccag   3780
cggccaagtc accttggtcg cgaacaatcc gaagctgaat ctggaccaaa gcgccaagtt   3840
gaatgtggag atgggcaaaa tccatgcgaa tcagaagtat cgcgcactga ttgtcggcac   3900
tgcggacggc attaagaact ttacttccga cgcggacgcc attgcagcgg gttatgtgaa   3960
agaaaccgat agcaacggcg tgctgacctt cggtgctaac gacattaagg gctacgaaac   4020
gtttgatatg agcggtttcg tggcggtgtg ggttccggtg ggtgcatctg acaatcagga   4080
cattcgtgtt gcgccgagca ccgaggcaaa gaaagaaggt gagctgacct tgaaggcgac   4140
ggaagcgtat gatagccagc tgatttacga aggctttagc aatttccaga cgatcccaga   4200
tggcagcgat ccgtccgtgt atacgaaccg caagattgcg gagaacgtgg atctgttcaa   4260
aagctggggt gtcaccagct ttgagatggc accgcaattt gtctcggcgg atgatggcac   4320
ctttctggat agcgttattc agaatggcta cgccttcgcc gaccgttatg acctggccat   4380
gtccaagaac aacaagtatg gtagcaaaga ggacctgcgt gatgcactga aagcactgca   4440
taaggcgggt attcaagcta tcgcagactg ggttccagac cagatctacc agctgccggg   4500
caaagaagtt gtcaccgcca cccgtacgga tggtgctggc cgtaagatcg cagacgcgat   4560
tatcgaccat tctctgtatg ttgcaaacag caaaagcagc ggcaaagatt atcaagcaaa   4620
gtacggtggc gagttcctgg ccgagctgaa agccaaatac ccggaaatgt tcaaagttaa   4680
catgattagc acgggtaagc cgattgatga ctccgtgaaa ttgaagcaat ggaaagccga   4740
gtacttcaat ggcaccaacg ttttggaacg tggtgtcggc tatgttctga gcgacgaggc   4800
gaccggtaag tatttcacgg tgaccaaaga aggcaatttc attccgctgc aactgacggg   4860
taaagagaaa gttatcacgg gtttctccag cgatggtaag ggtatcacct atttcggtac   4920
gagcggtacg caggcgaagt ctgcgtttgt taccttcaat ggtaacacct actatttcga   4980
cgcgcgtggc cacatggtta ccaatagcga atacagcccg aatggcaagg acgtctaccg   5040
ttttctgccg aacggtatca tgctgagcaa tgcgttttac attgatgcga acggtaatac   5100
```

-continued

```
ctacctgtac aactctaagg gtcaaatgta caaaggcggt tacacgaaat tcgatgtttc   5160
tgaaacggat aaggacggta aagagtccaa ggtcgtcaag ttccgctact ttacgaacga   5220
aggcgtcatg gccaagggtg ttaccgtcat tgatggtttt acccaatact tcggtgagga   5280
cggctttcaa gcgaaggata agctggtcac cttcaagggc aagacgtatt acttcgacgc   5340
acacactggt aatggtatca aagatacctg gcgcaatatc aatggtaaat ggtactattt   5400
cgacgcgaat ggcgttgctg cgaccggtgc gcaggtgatt aacggccaga aactgtactt   5460
caacgaggat ggctcccaag tcaaaggcgg cgtggttaag aacgcagacg gcacctatag   5520
caaatacaaa gaaggttttg gtgagctggt tactaacgag tttttcacga ctgatggcaa   5580
tgtttggtac tacgccggtg caaatggtaa aaccgttacc ggtgcacaag tgatcaacgg   5640
ccaacatttg tacttcaatg cggacggttc ccaggtgaag ggtggcgttg tcaagaacgc   5700
ggatggcacc tacagcaagt acaatgctag cactggtgaa cgtctgacga acgagttctt   5760
tacgaccggt gataacaatt ggtattacat tggcgcaaac ggtaagagcg tgacgggtga   5820
ggtcaagatt ggtgatgata cttacttttt cgcgaaggat ggcaaacaag ttaaaggtca   5880
aaccgtcagc gccggtaatg gtcgcattag ctactactac ggtgacagcg gcaagcgtgc   5940
ggttagcacc tggattgaga ttcagccggg tgtttatgtg tatttcgaca aaaacggttt   6000
ggcgtaccct ccgcgtgttc tgaattaatg agtctagact gcagggtacc aagcttcccc   6060
aagggcgaca ccccataatt agcccgggcg aaaggcccag tctttcgact gagcctttcg   6120
ttttatttga tgcctggcag ttccctactc tcgcatgggg agtccccaca ctaccatcgg   6180
cgctacggcg tttcacttct gagttcggca tggggtcagg tgggaccacc gcgctactgc   6240
cgccaggcaa acaaggggtg ttatgagcca tattcaggta taaatgggct cgcgataatg   6300
ttcagaattg gttaattggt tgtaacactg acccctattt gtttattttt ctaaatacat   6360
tcaaatatgt atccgctcat gagacaataa ccctgataaa tgcttcaata atattgaaaa   6420
aggaagaata tgagtattca acatttccgt gtcgccctta ttccctttt tgcggcattt   6480
tgccttcctg tttttgctca cccagaaacg ctggtgaaag taaaagatgc tgaagatcag   6540
ttgggtgcac gagtgggtta catcgaactg gatctcaaca gcggtaagat ccttgagagt   6600
tttcgccccg aagaacgttt tccaatgatg agcactttta aagttctgct atgtggcgcg   6660
gtattatccc gtattgacgc cgggcaagag caactcggtc gccgcataca ctattctcag   6720
aatgacttgg ttgagtactc accagtcaca gaaaagcatc ttacggatgg catgacagta   6780
agagaattat gcagtgctgc cataaccatg agtgataaca ctgcggccaa cttacttctg   6840
acaacgatcg gaggaccgaa ggagctaacc gctttttttgc acaacatggg ggatcatgta   6900
actcgccttg atcgttggga accggagctg aatgaagcca taccaaacga cgagcgtgac   6960
accacgatgc ctgtagcgat ggcaacaacg ttgcgcaaac tattaactgg cgaactactt   7020
actctagctt cccggcaaca attaatagac tggatggagg cggataaagt tgcaggacca   7080
cttctgcgct cggcccttcc ggctggctgg tttattgctg ataaatccgg agccggtgag   7140
cgtggttctc gcggtatcat cgcagcgctg gggccagatg gtaagccctc ccgtatcgta   7200
gttatctaca cgacggggag tcaggcaact atggatgaac gaaatagaca gatcgctgag   7260
ataggtgcct cactgattaa gcattggtaa gcggcgcgcc atcgaatggc gcaaaacctt   7320
tcgcggtatg gcatgatagc gcccggaaga gagtcaattc agggtggtga atatgaaacc   7380
agtaacgtta tacgatgtcg cagagtatgc cggtgtctct tatcagaccg tttcccgcgt   7440
ggtgaaccag gccagccacg tttctgcgaa aacgcgggaa aaagtggaag cggcgatggc   7500
```

```
ggagctgaat tacattccca accgcgtggc acaacaactg gcgggcaaac agtcgttgct   7560

gattggcgtt gccacctcca gtctggccct gcacgcgccg tcgcaaattg tcgcggcgat   7620

taaatctcgc gccgatcaac tgggtgccag cgtggtggtg tcgatggtag aacgaagcgg   7680

cgtcgaagcc tgtaaagcgg cggtgcacaa tcttctcgcg caacgcgtca gtgggctgat   7740

cattaactat ccgctggatg accaggatgc cattgctgtg gaagctgcct gcactaatgt   7800

tccggcgtta tttcttgatg tctctgacca gacacccatc aacagtatta ttttctccca   7860

tgaggacggt acgcgactgg gcgtggagca tctggtcgca ttgggtcacc agcaaatcgc   7920

gctgttagcg ggcccattaa gttctgtctc ggcgcgtctg cgtctggctg gctggcataa   7980

atatctcact cgcaatcaaa ttcagccgat agcggaacgg gaaggcgact ggagtgccat   8040

gtccggtttt caacaaacca tgcaaatgct gaatgagggc atcgttccca ctgcgatgct   8100

ggttgccaac gatcagatgg cgctgggcgc aatgcgcgcc attaccgagt ccgggctgcg   8160

cgttggtgcg gatatctcgg tagtgggata cgacgatacc gaagatagct catgttatat   8220

cccgccgtta accaccatca aacaggattt tcgcctgctg gggcaaacca gcgtggaccg   8280

cttgctgcaa ctctctcagg gccaggcggt gaagggcaat cagctgttgc cagtctcact   8340

ggtgaaaaga aaaaccaccc tggcgcccaa tacgcaaacc gcctctcccc gcgcgttggc   8400

cgattcatta atgcagctgg cacgacaggt ttcccgactg gaaagcgggc agtga        8455
```

```
<210> SEQ ID NO 3
<211> LENGTH: 1518
<212> TYPE: PRT
<213> ORGANISM: Streptococcus salivarius

<400> SEQUENCE: 3

Met Glu Asn Lys Ile His Tyr Lys Leu His Lys Val Lys Lys Gln Trp
1               5                   10                  15

Val Thr Ile Ala Val Ala Ser Val Ala Leu Ala Thr Val Leu Gly Gly
            20                  25                  30

Leu Ser Val Thr Thr Ser Ser Val Ser Ala Asp Glu Thr Gln Asp Lys
        35                  40                  45

Thr Val Thr Gln Ser Asn Ser Gly Thr Thr Ala Ser Leu Val Thr Ser
    50                  55                  60

Pro Glu Ala Thr Lys Glu Ala Asp Lys Arg Thr Asn Thr Lys Glu Ala
65                  70                  75                  80

Asp Val Leu Thr Pro Ala Lys Glu Thr Asn Ala Val Glu Thr Ala Thr
                85                  90                  95

Thr Thr Asn Thr Gln Ala Thr Ala Glu Ala Ala Thr Thr Ala Thr Thr
            100                 105                 110

Ala Asp Val Ala Val Ala Ala Val Pro Asn Lys Glu Ala Val Val Thr
        115                 120                 125

Thr Asp Ala Pro Ala Val Thr Thr Glu Lys Ala Glu Glu Gln Pro Ala
    130                 135                 140

Thr Val Lys Ala Glu Val Val Asn Thr Glu Val Lys Ala Pro Glu Ala
145                 150                 155                 160

Ala Leu Lys Asp Ser Glu Val Glu Ala Ala Leu Ser Leu Lys Asn Ile
                165                 170                 175

Lys Asn Ile Asp Gly Lys Tyr Tyr Tyr Val Asn Glu Asp Gly Ser His
            180                 185                 190

Lys Glu Asn Phe Ala Ile Thr Val Asn Gly Gln Leu Leu Tyr Phe Gly
        195                 200                 205
```

```
Lys Asp Gly Ala Leu Thr Ser Ser Ser Thr Tyr Ser Phe Thr Pro Gly
    210                 215                 220

Thr Thr Asn Ile Val Asp Gly Phe Ser Ile Asn Asn Arg Ala Tyr Asp
225                 230                 235                 240

Ser Ser Glu Ala Ser Phe Glu Leu Ile Asp Gly Tyr Leu Thr Ala Asp
                245                 250                 255

Ser Trp Tyr Arg Pro Ala Ser Ile Ile Lys Asp Gly Val Thr Trp Gln
            260                 265                 270

Ala Ser Thr Ala Glu Asp Phe Arg Pro Leu Leu Met Ala Trp Trp Pro
        275                 280                 285

Asn Val Asp Thr Gln Val Asn Tyr Leu Asn Tyr Met Ser Lys Val Phe
    290                 295                 300

Asn Leu Asp Ala Lys Tyr Ser Ser Thr Asp Lys Gln Glu Thr Leu Lys
305                 310                 315                 320

Val Ala Ala Lys Asp Ile Gln Ile Lys Ile Glu Gln Lys Ile Gln Ala
                325                 330                 335

Glu Lys Ser Thr Gln Trp Leu Arg Glu Thr Ile Ser Ala Phe Val Lys
            340                 345                 350

Thr Gln Pro Gln Trp Asn Lys Glu Thr Glu Asn Tyr Ser Lys Gly Gly
        355                 360                 365

Gly Glu Asp His Leu Gln Gly Gly Ala Leu Leu Tyr Val Asn Asp Ser
    370                 375                 380

Arg Thr Pro Trp Ala Asn Ser Asp Tyr Arg Arg Leu Asn Arg Thr Ala
385                 390                 395                 400

Thr Asn Gln Thr Gly Thr Ile Asp Lys Ser Ile Leu Asp Glu Gln Ser
                405                 410                 415

Asp Pro Asn His Met Gly Gly Phe Asp Phe Leu Leu Ala Asn Asp Val
            420                 425                 430

Asp Leu Ser Asn Pro Val Val Gln Ala Glu Gln Leu Asn Gln Ile His
        435                 440                 445

Tyr Leu Met Asn Trp Gly Ser Ile Val Met Gly Asp Lys Asp Ala Asn
    450                 455                 460

Phe Asp Gly Ile Arg Val Asp Ala Val Asp Asn Val Asp Ala Asp Met
465                 470                 475                 480

Leu Gln Leu Tyr Thr Asn Tyr Phe Arg Glu Tyr Tyr Gly Val Asn Lys
                485                 490                 495

Ser Glu Ala Asn Ala Leu Ala His Ile Ser Val Leu Glu Ala Trp Ser
            500                 505                 510

Leu Asn Asp Asn His Tyr Asn Asp Lys Thr Asp Gly Ala Ala Leu Ala
        515                 520                 525

Met Glu Asn Lys Gln Arg Leu Ala Leu Leu Phe Ser Leu Ala Lys Pro
    530                 535                 540

Ile Lys Glu Arg Thr Pro Ala Val Ser Pro Leu Tyr Asn Asn Thr Phe
545                 550                 555                 560

Asn Thr Thr Gln Arg Asp Glu Lys Thr Asp Trp Ile Asn Lys Asp Gly
                565                 570                 575

Ser Lys Ala Tyr Asn Glu Asp Gly Thr Val Lys Gln Ser Thr Ile Gly
            580                 585                 590

Lys Tyr Asn Glu Lys Tyr Gly Asp Ala Ser Gly Asn Tyr Val Phe Ile
        595                 600                 605

Arg Ala His Asp Asn Asn Val Gln Asp Ile Ile Ala Glu Ile Ile Lys
    610                 615                 620
```

```
Lys Glu Ile Asn Pro Lys Ser Asp Gly Phe Thr Ile Thr Asp Ala Glu
625                 630                 635                 640

Met Lys Gln Ala Phe Glu Ile Tyr Asn Lys Asp Met Leu Ser Ser Asp
                645                 650                 655

Lys Lys Tyr Thr Leu Asn Asn Ile Pro Ala Ala Tyr Ala Val Met Leu
            660                 665                 670

Gln Asn Met Glu Thr Ile Thr Arg Val Tyr Tyr Gly Asp Leu Tyr Thr
        675                 680                 685

Asp Asp Gly His Tyr Met Glu Thr Lys Ser Pro Tyr Tyr Asp Thr Ile
    690                 695                 700

Val Asn Leu Met Lys Ser Arg Ile Lys Tyr Val Ser Gly Gly Gln Ala
705                 710                 715                 720

Gln Arg Ser Tyr Trp Leu Pro Thr Asp Gly Lys Met Asp Asn Ser Asp
                725                 730                 735

Val Glu Leu Tyr Arg Thr Asn Glu Val Tyr Thr Ser Val Arg Tyr Gly
            740                 745                 750

Lys Asp Ile Met Thr Ala Asn Asp Thr Glu Gly Ser Lys Tyr Ser Arg
        755                 760                 765

Thr Ser Gly Gln Val Thr Leu Val Ala Asn Asn Pro Lys Leu Asn Leu
    770                 775                 780

Asp Gln Ser Ala Lys Leu Asn Val Glu Met Gly Lys Ile His Ala Asn
785                 790                 795                 800

Gln Lys Tyr Arg Ala Leu Ile Val Gly Thr Ala Asp Gly Ile Lys Asn
                805                 810                 815

Phe Thr Ser Asp Ala Asp Ala Ile Ala Ala Gly Tyr Val Lys Glu Thr
            820                 825                 830

Asp Ser Asn Gly Val Leu Thr Phe Gly Ala Asn Asp Ile Lys Gly Tyr
        835                 840                 845

Glu Thr Phe Asp Met Ser Gly Phe Val Ala Val Trp Val Pro Val Gly
    850                 855                 860

Ala Ser Asp Asn Gln Asp Ile Arg Val Ala Pro Ser Thr Glu Ala Lys
865                 870                 875                 880

Lys Glu Gly Glu Leu Thr Leu Lys Ala Thr Glu Ala Tyr Asp Ser Gln
                885                 890                 895

Leu Ile Tyr Glu Gly Phe Ser Asn Phe Gln Thr Ile Pro Asp Gly Ser
            900                 905                 910

Asp Pro Ser Val Tyr Thr Asn Arg Lys Ile Ala Glu Asn Val Asp Leu
        915                 920                 925

Phe Lys Ser Trp Gly Val Thr Ser Phe Glu Met Ala Pro Gln Phe Val
    930                 935                 940

Ser Ala Asp Asp Gly Thr Phe Leu Asp Ser Val Ile Gln Asn Gly Tyr
945                 950                 955                 960

Ala Phe Ala Asp Arg Tyr Asp Leu Ala Met Ser Lys Asn Asn Lys Tyr
                965                 970                 975

Gly Ser Lys Glu Asp Leu Arg Asp Ala Leu Lys Ala Leu His Lys Ala
            980                 985                 990

Gly Ile Gln Ala Ile Ala Asp Trp  Val Pro Asp Gln Ile  Tyr Gln Leu
        995                 1000                1005

Pro Gly  Lys Glu Val Val Thr  Ala Thr Arg Thr Asp  Gly Ala Gly
    1010                1015                1020

Arg Lys  Ile Ala Asp Ala Ile  Ile Asp His Ser Leu  Tyr Val Ala
    1025                1030                1035
```

```
Asn Ser  Lys Ser Ser Gly Lys  Asp Tyr Gln Ala Lys  Tyr Gly Gly
    1040                 1045                 1050

Glu Phe  Leu Ala Glu Leu Lys  Ala Lys Tyr Pro Glu  Met Phe Lys
    1055                 1060                 1065

Val Asn  Met Ile Ser Thr Gly  Lys Pro Ile Asp Asp  Ser Val Lys
    1070                 1075                 1080

Leu Lys  Gln Trp Lys Ala Glu  Tyr Phe Asn Gly Thr  Asn Val Leu
    1085                 1090                 1095

Glu Arg  Gly Val Gly Tyr Val  Leu Ser Asp Glu Ala  Thr Gly Lys
    1100                 1105                 1110

Tyr Phe  Thr Val Thr Lys Glu  Gly Asn Phe Ile Pro  Leu Gln Leu
    1115                 1120                 1125

Thr Gly  Lys Glu Lys Val Ile  Thr Gly Phe Ser Ser  Asp Gly Lys
    1130                 1135                 1140

Gly Ile  Thr Tyr Phe Gly Thr  Ser Gly Thr Gln Ala  Lys Ser Ala
    1145                 1150                 1155

Phe Val  Thr Phe Asn Gly Asn  Thr Tyr Tyr Phe Asp  Ala Arg Gly
    1160                 1165                 1170

His Met  Val Thr Asn Ser Glu  Tyr Ser Pro Asn Gly  Lys Asp Val
    1175                 1180                 1185

Tyr Arg  Phe Leu Pro Asn Gly  Ile Met Leu Ser Asn  Ala Phe Tyr
    1190                 1195                 1200

Ile Asp  Ala Asn Gly Asn Thr  Tyr Leu Tyr Asn Ser  Lys Gly Gln
    1205                 1210                 1215

Met Tyr  Lys Gly Gly Tyr Thr  Lys Phe Asp Val Ser  Glu Thr Asp
    1220                 1225                 1230

Lys Asp  Gly Lys Glu Ser Lys  Val Val Lys Phe Arg  Tyr Phe Thr
    1235                 1240                 1245

Asn Glu  Gly Val Met Ala Lys  Gly Val Thr Val Ile  Asp Gly Phe
    1250                 1255                 1260

Thr Gln  Tyr Phe Gly Glu Asp  Gly Phe Gln Ala Lys  Asp Lys Leu
    1265                 1270                 1275

Val Thr  Phe Lys Gly Lys Thr  Tyr Tyr Phe Asp Ala  His Thr Gly
    1280                 1285                 1290

Asn Gly  Ile Lys Asp Thr Trp  Arg Asn Ile Asn Gly  Lys Trp Tyr
    1295                 1300                 1305

Tyr Phe  Asp Ala Asn Gly Val  Ala Ala Thr Gly Ala  Gln Val Ile
    1310                 1315                 1320

Asn Gly  Gln Lys Leu Tyr Phe  Asn Glu Asp Gly Ser  Gln Val Lys
    1325                 1330                 1335

Gly Gly  Val Val Lys Asn Ala  Asp Gly Thr Tyr Ser  Lys Tyr Lys
    1340                 1345                 1350

Glu Gly  Phe Gly Glu Leu Val  Thr Asn Glu Phe Phe  Thr Thr Asp
    1355                 1360                 1365

Gly Asn  Val Trp Tyr Tyr Ala  Gly Ala Asn Gly Lys  Thr Val Thr
    1370                 1375                 1380

Gly Ala  Gln Val Ile Asn Gly  Gln His Leu Tyr Phe  Asn Ala Asp
    1385                 1390                 1395

Gly Ser  Gln Val Lys Gly Gly  Val Val Lys Asn Ala  Asp Gly Thr
    1400                 1405                 1410

Tyr Ser  Lys Tyr Asn Ala Ser  Thr Gly Glu Arg Leu  Thr Asn Glu
    1415                 1420                 1425
```

-continued

```
Phe Phe  Thr Thr Gly Asp Asn  Asn Trp Tyr Tyr Ile  Gly Ala Asn
    1430                 1435                 1440

Gly Lys  Ser Val Thr Gly Glu  Val Lys Ile Gly Asp  Asp Thr Tyr
    1445                 1450                 1455

Phe Phe  Ala Lys Asp Gly Lys  Gln Val Lys Gly Gln  Thr Val Ser
    1460                 1465                 1470

Ala Gly  Asn Gly Arg Ile Ser  Tyr Tyr Tyr Gly Asp  Ser Gly Lys
    1475                 1480                 1485

Arg Ala  Val Ser Thr Trp Ile  Glu Ile Gln Pro Gly  Val Tyr Val
    1490                 1495                 1500

Tyr Phe  Asp Lys Asn Gly Leu  Ala Tyr Pro Pro Arg  Val Leu Asn
    1505                 1510                 1515
```

What is claimed is:

1. A process comprising subjecting one or more filaments comprising poly(α(1→3) glucan) to a tension below the breaking strength of the one or more filaments at 350° C.;

subjecting the thus tensioned one or more filaments to a first thermal exposure by heating said one or more filaments to a temperature in the range of 160 to 200° C. in air for a duration in the range of 5 to 15 minutes;

subjecting the thus heated one or more filaments to a second thermal exposure by further heating said one or more filaments, still under tension, from a first temperature in the range of 200 to 250° C. to a second temperature in the range of 300 to 350° C., thereby preparing one or more thermally stabilized filaments;

subjecting said one or more stabilized filaments in a zero tension state to a third thermal exposure by heating said one or stabilized filaments to a temperature in the range of 700 to 1500° C. in an inert atmosphere for a duration in the range of 0.5 to 5 minutes, thereby preparing one or more carbonized filaments.

2. The process of claim 1 wherein the first thermal exposure is effected at a temperature in the range of 175 to 185° C. for a duration of 7.5 to 12.5 minutes.

3. The process of claim 1 wherein said second thermal exposure is effected in a series of well-defined steps between the first temperature and the second temperature, with a hold period between steps, and a heating rate from step to step in excess of 10° C. per minute.

4. The process of claim 1 wherein said first temperature is in the range of 230-250° C., and said second temperature is in the range of 310 to 330° C.

5. The process of claim 1 wherein the third thermal exposure is effected at a temperature in the range of 800 to 1000° C. for a duration in the range of 1 to 2 minutes.

* * * * *